United States Patent [19]

Del Grande

[11] Patent Number: 4,846,501

[45] Date of Patent: Jul. 11, 1989

[54] WORK ORDER SET WITH INTEGRAL I.D. TAGS

[75] Inventor: Paul E. Del Grande, Mississauga, Canada

[73] Assignee: Impact Business Forms Limited, Mississauga, Canada

[21] Appl. No.: 160,752

[22] Filed: Feb. 26, 1988

[51] Int. Cl.[4] ..... B41L 1/04; B41L 1/20; B42D 15/00; B65D 27/34

[52] U.S. Cl. ..... 282/9 R; 282/11.5 R; 283/23; 229/69

[58] Field of Search ..... 282/9 R, 10, 11.5 A, 282/11.5 R, 13, 23 R, 24 A, 24 R, 27 A, 27.5; 283/23; 229/69; 493/325; 40/360

[56] References Cited

U.S. PATENT DOCUMENTS

| | | | |
|---|---|---|---|
| 1,269,026 | 6/1918 | Weinfeld | 283/23 |
| 1,281,897 | 10/1918 | Bender | 283/23 |
| 1,320,112 | 10/1919 | Barsby et al. | 283/23 |
| 1,385,156 | 7/1921 | Small | 283/23 |
| 1,702,026 | 2/1929 | Austin | 282/27 A |
| 3,970,397 | 7/1976 | Armstrong | 40/360 |
| 4,208,066 | 6/1980 | Steidinger | 282/24 R |
| 4,493,496 | 1/1985 | Kaluza | 229/69 |
| 4,624,481 | 11/1986 | Kercher | 282/11.5 R |

*Primary Examiner*—Frank T. Yost
*Assistant Examiner*—Paul M. Heyrana, Sr.
*Attorney, Agent, or Firm*—Shoemaker and Mattare, Ltd.

[57] ABSTRACT

A work order set for vehicle repair work includes a bottom sheet of relatively stiff card stock, and at least one upper sheet of relatively thin paper stock. The sheets are secured together along at least one edge, and define a first area for receiving data regarding the work order to which the set pertains. All of the first areas are superimposed. All of the sheets further define a second area, and all second areas are superimposed. The second area of the bottom sheet is divided by perforations into three detachable portions, each bearing the same work order number. One portion is intended for attachment to the vehicle, another portion is intended to be given to the customer, and the third portion is intended for attachment to the vehicle starter key.

4 Claims, 1 Drawing Sheet

WORK ORDER SET WITH INTEGRAL I.D. TAGS

This invention relates to work order sets for use in the automotive and related industries, and has to do particularly with an improved work order set which eliminates the risk of carrying out a work order on the wrong vehicle.

BACKGROUND OF THIS INVENTION

Currently, work order sets used by automotive repair shops and dealerships consist of a bottom sheet of relatively stiff card stock and two or more upper sheets of relatively thin paper stock, all of which have applied to them a printed grid matrix for the entry of pertinent information such as the name and address of the vehicle owner, the date on which the vehicle is brought in for work, the work instructions, the signature of the owner, and so on. The bottom sheet is of thicker stock because it is the copy that will go to the shop and be handled by mechanics. Because of the grease and dirt generally found in such areas, it is necessary to make the bottom sheet of thicker stock that is more resistant to tearing. The other copies are for the accounting office and for the customer. Still further copies may be included for other related purposes, all such copies on relatively thin paper stock.

Conventionally, such work order sets are provided in a format that is compatible with computing facilities, with tear-off perforated strips along either side. When the strips are torn away, the various sheets can be separated.

The problem remains as to how to ensure that the work called for in the work order is carried out on the proper vehicle. Conventionally, this is taken care of by providing, entirely separately and independent of the work order set, a series of smaller cards which are perforated into three areas: a larger area containing a given number (typically four digits) of substantial size, a first smaller area which is a key tag and is intended to be attached to the vehicle key, and a second smaller area which is a claim check to be given to the customer. The larger area has a large aperture adjacent one edge, and the aperture is joined to the edge by a slit. The purpose of the aperture is to permit the larger portion to be secured to the interior rearview mirror of the vehicle. Conventionally, because the number on the separate perforated card is not found anywhere on the work order set, it is necessary to write the number on the set in order to minimize the risk of doing work on the wrong vehicle.

I have now recognized that it is possible to design a workset in such a way as to provide the identification tags as well, and this is the main aim of the present invention.

GENERAL DESCRIPTION OF THIS INVENTION

"More particularly, this invention provides a plurality of work order sets for use in the repair of vehicles, the work order sets being connected in series together at detachable lines of weakness, each work order set comprising:

a bottom sheet of relatively stiff card stock, and at least one upper sheet of relatively thin paper stock overlying the bottom sheet, all sheets being secured together along at least one edge in a detachable manner, all sheets defining a first area for receiving data regarding the work order to which the set pertains, all said first areas being superimposed, all sheets further defining a second area, all said second areas being superimposed, transfer means for transferring impressions from the first area of the uppermost sheet to the first areas of all underlying sheets, the second area of the bottom sheet being divided by lines of weakness into first, second and third detachable portions, each bearing the same work order number, the first detachable portion being larger than the other detachable portions and having means by which it can be attached to a vehicle to which the work order pertains, the second portion being a claim check for the customer, and the third portion being intended for attachment to the starter key to which the work order pertains, the first area of the bottom sheet containing the work order number at least once."

GENERAL DESCRIPTION OF THE DRAWINGS

One embodiment of this invention is illustrated in the accompanying drawings, in which like numerals denote like parts throughout the several views, and in which.

DETAILED DESCRIPTION OF THE DRAWINGS

Figure 3:
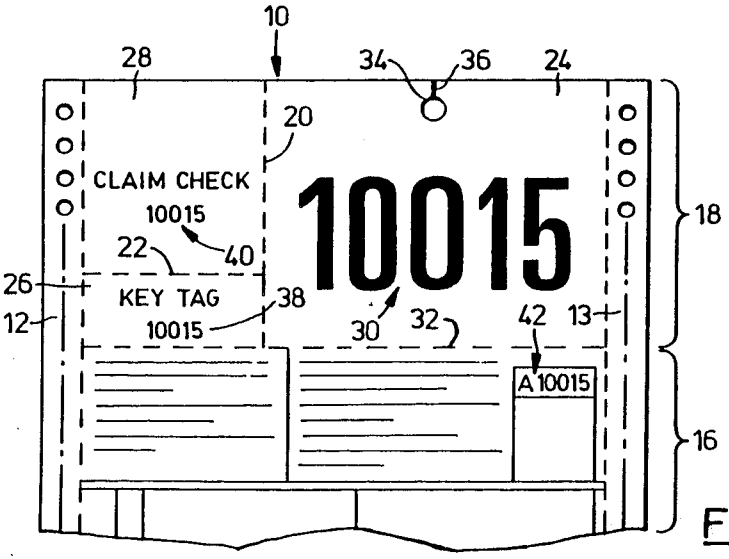
FIG. 3 is a plan view of the bottom sheet of a work order set constructed in accordance with this invention.

Attention is first directed to FIG. 3, which shows the bottom sheet of a work order set in accordance with this invention. The bottom sheet is identified at the numeral 10 and is generally rectangular with longer sides at the right and left. Along the right and left margins, perforated tear-off strips 12 and 13 are provided in the usual manner.

The bottom sheet 10 is divided generally into a first area 16 and a second area 18. The first area 16 of the bottom sheet 10 is printed with a data matrix for receiving information such as the nature of the work to be done, the identification of the owner and of the vehicle, his telephone number, address, etc.

The second area 18 of the bottom sheet 10 is divided by perforation lines 20 and 22 into a larger portion 24, a smaller portion 26, and an intermediate portion 28. The larger portion 24 is printed with a number 30 on a large scale, the number identifying the particular work order and intended to be attached to the vehicle itself after the portion 24 is removed from the remainder of the bottom sheet 10. It will be noted that the second area 18 and the first area 16 are separated by a further perforation line 32 in order to facilitate removal of the portion 24.

The larger portion 24 has a punched hole 34 adjacent the upper edge of the portion 24, the opening 34 being joined to the upper edge by a perforated slit 36. This allows the portion 24 to be attached, for example, to the support arm of the internal rearview mirror of the vehicle.

The smaller portion 26 is a key tag, and has at 38 the same number as is found at 30 on the portion 24. The intermediate portion 28 is the claim check to be given to the customer, and this also carries at 40 the same number as is found at 30 on the portion 24.

The first area 16 also contains the number which is seen at 30 on the portion 24, namely at the location 42 at the upper right of the first area 16.

Figure 2:
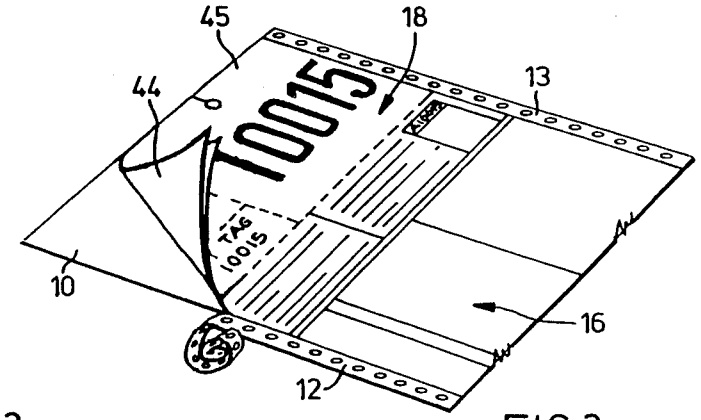
FIG. 2 is a perspective view of a work order set constructed in accordance with this invention.

Collated above the bottom sheet 10 for each workset are two or more additional sheets of thin paper stock, these being seen at 44 and 45 in FIG. 2. Both of these sheets contain substantially the same information matrix in the first area 16 as is found in the same area on the bottom sheet 10. The sheets 44 and 45 do not, however, contain the same information as the bottom sheet in the second area 18. This area can be used instead to print advertising material, safety recommendations, service work that has been performed on the specific vehicle, etc.

Figure 1:
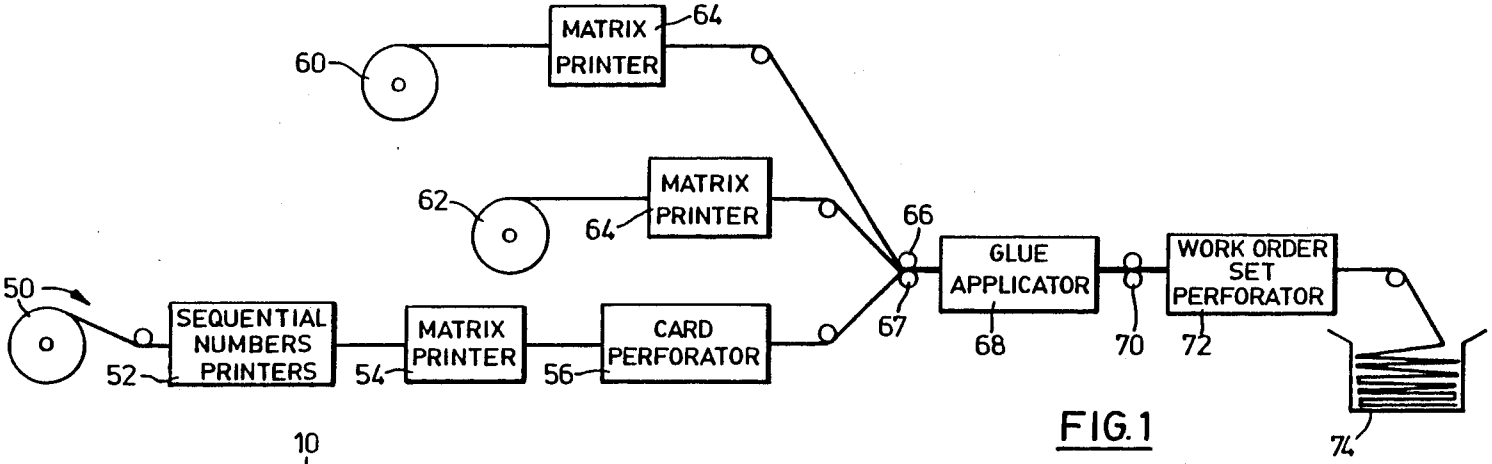
FIG. 1 is a schematic drawing of the various components necessary to carry out the method of this invention.

The procedure utilized to manufacture the work order sets of the present invention is illustrtated in FIG. 1. A roll 50 of relatively stiff card stock is provided, and from the roll 50 the card stock is fed through a sequential numbers printer 52, which prints sequentially the numbers shown at 30, 38, 40 and 42 in FIG. 3 at successive, equidistant locations along the roll. This printer may be matrix or letterpress. The sequential numbers printer prints all instances of the number (shown as "10015" in FIG. 3). The printed material then passes through a litho press 54 which prints on the bottom sheet 10 the remainder of the datareceiving grid in the first area 16, as well as the additional information in the second area 18. The printed material then passes to a card perforator 56 which applies the perforation lines 20, 22 and 30, and also stamps the opening 34 and the slit 36. The thicker card stock from roll 50 is then ready to be married up with the upper sheets. The latter are provided in the form of two rolls 60 and 62, each of which feeds through a litho press 64 which applies all of the information found in the first area 16 of the bottom sheet 10, and can also apply any desired information in the second area 18 (although this information will not be the same as that appearing on the bottom sheet 10).

The three webs are then fed into the nip between two rollers 66 and 67, from where they pass through a glue applicator 68, compression rollers 70, and a work order set perforator 72, which applies the common perforation lines separating one workset from another. After feeding out of the work order set perforator 72, the composite material can be fan folded into a suitable container 72.

It will be understood that the upper sheets 44 and 45 include some means by which material written, typed or printed on the first area 16 of the on the top sheet can be transferred to all lower sheets. This can include an integral carbon layer on the underside of all sheets except the bottom sheet 10, or separate carbon paper, or other known means.

In use, the necessary information regarding the customer, the vehicle and the job to be done is then written, printed or typed on the top sheet. This information will then transfer down to all of the remaining sheets. When the top sheet has been completely filled out as required, the side marginal portions 12 and 13 are torn off to separate the sheets. The bottom sheet is then further separated into the portions 24, 26 and 28, which are removed from the remainder of the bottom sheet 10. The first area 16 of the bottom sheet 10 is then given to the service shop to indicate the work to be done. The portion 24 is hung on the internal rearview mirror of the vehicle, while the customer is given portion 28 and the key tag 26 is connected to the vehicle starter key. The upper sheets 44 and 45 (and other such upper sheets if they are present) are then distributed as necessary. One sheet could be given to the customer, and another could go to the accounting department.

While one embodiment of this invention has been illustrated in the accompanying drawings and described hereinabove, it will be evident to those skilled in the art that changes and modifications may be made therein without departing from the essence of this invention, as set forth in the appended claims.

The embodiments of the invention in which an exclusive property or privilege is claimed are defined as follows:

1. A plurality of work order sets for use in the repair of vehicles, the work order sets being connected in series together at detachable lines of weakness, each work order set comprising:

a bottom sheet of relatively stiff card stock and at least one upper sheet of relatively thin paper stock overlying the bottom sheet, all sheets being secured together along at least one edge in a detachable manner, all sheets defining a first area for receiving data regarding the work order to which the set pertains, all said first areas being superimposed, all sheets further defining a second area, all said second areas being superimposed, transfer means for transferring impressions from the first area of the uppermost sheet to the first areas of all underlying sheets, the second area of the bottom sheet being divided by lines of weakness into first, second and third detachable portions, each bearing the same work order number, the first detachable portion being larger than the other detachable portions and having means by which it can be attached to a vehicle to which the work order pertains, the second portion being a claim check for the customer, and the third portion being intended for attachment to the starter key to which the work order pertains, the first area of the bottom sheet containing the work order number at least once.

2. The invention claimed in claim 1, in which said means on the first detachable portion comprises a prestamped opening adjacent one edge to allow securement to a projection from the vehicle.

3. The invention claimed in claim 1, in which there are at least two upper sheets.

4. The invention claimed in claim 2, in which there are at least two upper sheets.

* * * * *